United States Patent [19]

Yamada et al.

[11] Patent Number: 4,959,934

[45] Date of Patent: Oct. 2, 1990

[54] ELASTO-PLASTIC DAMPER FOR USE IN STRUCTURE

[75] Inventors: Toshikazu Yamada; Takuji Kobori; Mitsuo Sakamoto; Shozo Maeda; Shinichi Takahashi, all of Tokyo, Japan

[73] Assignee: Kajima Corporation, Tokyo, Japan

[21] Appl. No.: 301,317

[22] Filed: Jan. 24, 1989

[30] Foreign Application Priority Data

| | | | |
|---|---|---|---|
| Jan. 27, 1988 | [JP] | Japan | 63-16229 |
| Feb. 5, 1988 | [JP] | Japan | 63-25316 |
| Feb. 17, 1988 | [JP] | Japan | 63-034823 |
| Apr. 20, 1988 | [JP] | Japan | 63-97903 |
| Apr. 20, 1988 | [JP] | Japan | 63-97904 |

[51] Int. Cl.[5] ..... E04H 9/00

[52] U.S. Cl. ..... 52/167 R; 52/573

[58] Field of Search ..... 52/167, 235, 378, 573

[56] References Cited

U.S. PATENT DOCUMENTS 3,797,183 3/1974 Kobayashi et al. ..... 52/167

*Primary Examiner*—James L. Ridgill, Jr.

*Attorney, Agent, or Firm*—James H. Tilberry

[57] ABSTRACT

An elasto-plastic damper is disclosed which comprises either a metal block-like or a metal plate-like damper body, each having a plurality of spaced apart openings extending therethrough to provide elastic deformability to the damper body. The elasto-plastic damper is adapted to connect bifurcated axially aligned structural members in a building. When an earthquake tremor impacts upon the building, the vibrational energy transmitted to the bifurcated axially aligned structural members is attenuated by the interconnecting elasto-plastic dampers.

27 Claims, 10 Drawing Sheets

ELASTO-PLASTIC DAMPER FOR USE IN STRUCTURE

BACKGROUND OF THE INVENTION

1. Field of the Invention:

This invention relates to an elasto-plastic damper for use in a building structure, and, more particularly, to an elasto-plastic damper which is primarily installed in the frame of a structure to attenuate vibrations of the structure caused by earthquake tremors or the like.

2. Description of the Prior Art:

Prior art dampers used for absorbing vibrational energy of structures include elasto-plastic dampers utilizing elasto-plastic hysteresis attenuation, viscous dampers such as oil dampers which utilize viscosity and depend upon response speed at the time of occurrence of an earthquake, and friction dampers.

Among the above dampers, the elasto-plastic damper is more widely used because this damper requires no maintenance and provides a high degree of energy absorbability. The elasto-plastic damper generally takes the form of a steel bar, which is vertically supported in cantilever relation to either an upper or lower structure which are separated by a vibration isolation mechanism.

The steel bar damper displays great energy absorbability and stability when it is subjected to a repetitive force due to a relative horizontal shifting of the upper and lower structures. Since steel bar dampers are installed in order to absorb the vibrational energy of the entire upper structures, they are, of necessity, large in scale. In addition, since steel bar dampers are conventionally used in combination with multi-layer rubber supports, or like vibration isolation mechanisms, there are only a limited number of locations in a building structure where steel bar dampers may be installed.

SUMMARY OF THE INVENTION

According to the present invention, an elasto-plastic damper includes either a plate-like or a block-like formed damper body adapted to make the damper small in scale and to increase the degree of ease of installation in a building structure. The elasto-plastic damper is adapted to connect separated but axially aligned structural members wherein the damper is subjected to shearing deformation to absorb vibrational energy generated when relative movement of the structural members occurs.

In order to provide damper plastic deformability upon relative movement of the structural members, the damper body includes a plurality of transverse openings in the body, spaced apart from each other to provide a relatively low damper yield strength. By providing a plurality of openings, the section modulus in the medial portion of the damper body is smaller than that of the opposite ends thereof, and the medial portion, therefore, easily yields to an external force applied to the structure. As a result, the plastic deformability, i.e., energy absorbability, of the damper is enhanced.

Further, the plate thickness of the medial portion is not only provided with openings, but it may also be reduced in cross -sectional thickness, so that, when sufficiently stressed, the whole intermediate portion of the damper simultaneously plastically yields.

The elasto-plastic damper is installed so as to connect structural members such as beams, pillars, braces, braces and beams, braces and pillars, walls and beams, and walls and pillars. The damper is primarily connected to the structural members by means of threaded fasteners, such as nuts and bolts. The damper body has bolt holes bored in the opposite sides thereof as a matter of convenience of bolt placement and connection.

When the damper is of the plate-like species, the bolt holes extend through the damper body in the same axial direction as the openings. On the other hand, when the damper is of the block-like species, the bolt holes are axially aligned in the direction normal to the opening axes.

The energy absorbability of the elasto-plastic damper may be predetermined by proper selection of the size of each opening, the number of openings, and/or the plate or block dimensions.

A plurality of plate-like elasto-plastic dampers, differing from each other in rigidity and/or yield strength, may be arranged in parallel or in stacks and then connected to structural members to provide a damper which is suitable for the harmonic characteristics of the structure. Further, it is possible to select a plurality of dampers which are effective against a multi-stage earthquake.

The foregoing and other objects and features of the invention will become apparent from the following description of preferred embodiments of the invention with reference to the accompanying drawings.

DETAILED DESCRIPTION OF THE PREFERRED EMBODIMENTS

FIGS. 1 through 4 illustrate the most basic structure of an elasto-plastic damper D according to the present invention. Referring to FIGS. 1 through 4, the elasto-plastic damper D comprises a metal damper body $D_O$ and a plurality of openings formed in the damper body and extending therethrough.

Figure 1:
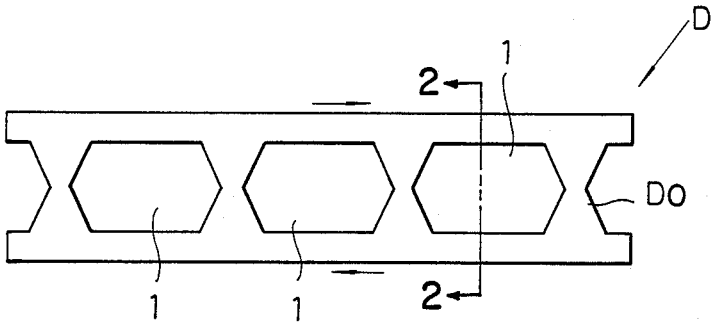
FIGS. 1, 3 and 4 are front elevational views showing basic structure of elasto-plastic dampers according to the present invention.
Figure 2:
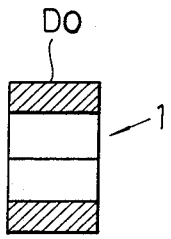
FIG. 2 is a sectional view taken along the line 2—2 of FIG. 1.
Figure 3:
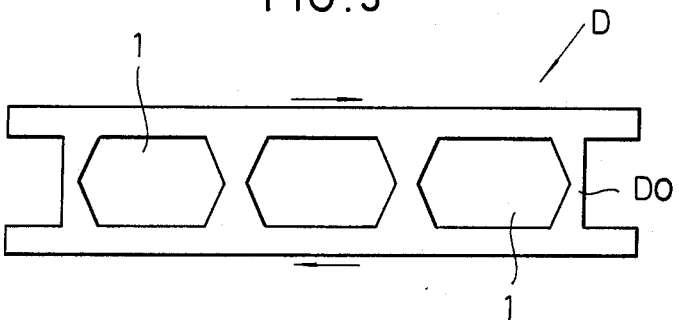
Figure 4:
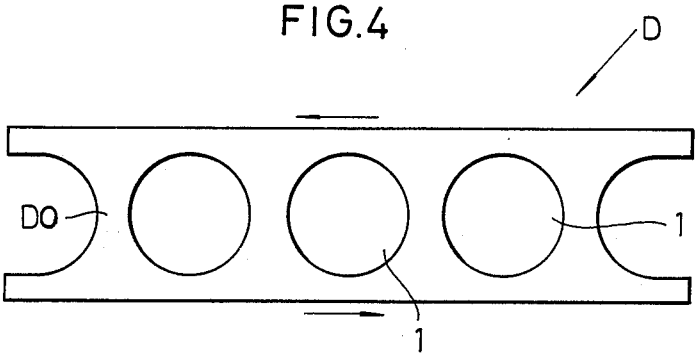
Figure 5:
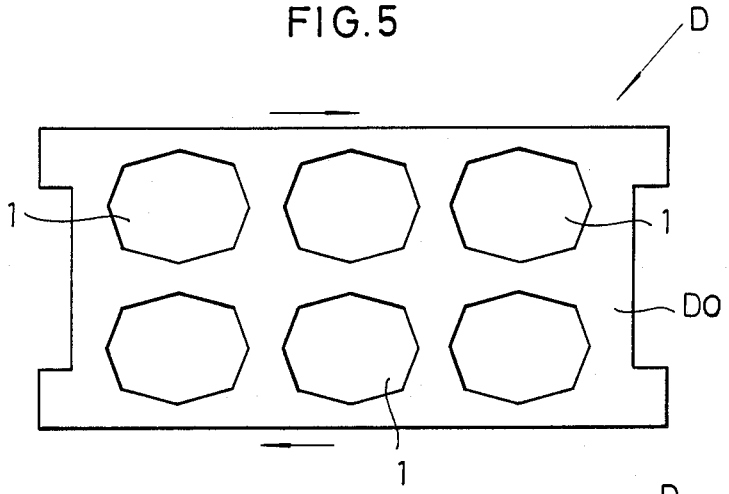
FIGS. 5 and 6 are front elevational views showing modifications of the damper of FIGS. 3 and 4, respectively, wherein openings are arranged in two tiers.
Figure 6:
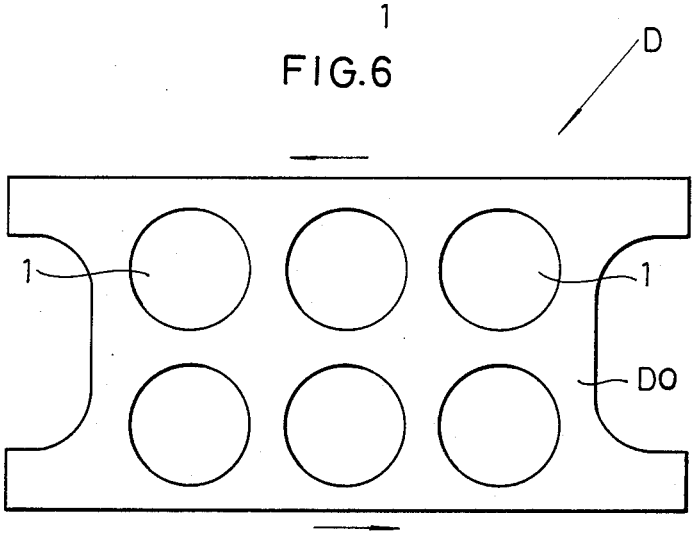

The damper body $D_O$ includes a block-like body or a plate-like body having a required plate thickness. A plurality of circular or polygonal openings 1 are bored in the damper body $D_O$ and are laterally spaced apart from each other. One tier openings, as shown in FIGS. 1–4, or multiple tier openings, as shown in FIGS. 5 and 6, may be formed depending upon the yield required of the damper.

Figure 7:
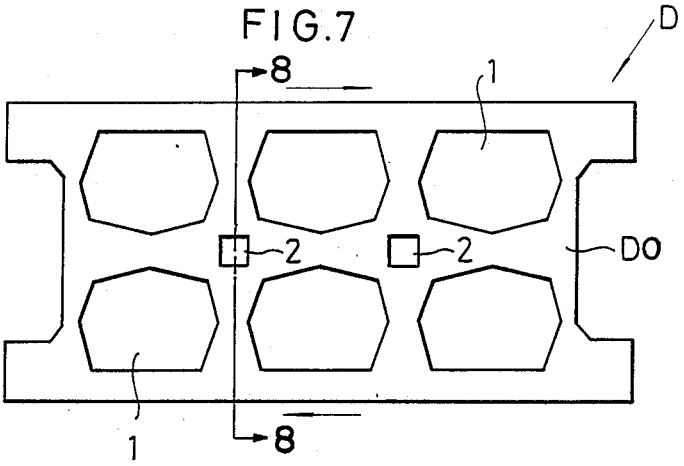
FIGS. 7 and 9 are front elevational views showing modifications of the dampers of FIGS. 5 and 6, respectively.
Figure 8:
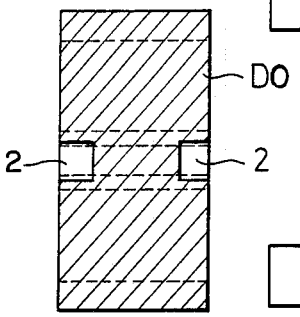
FIG. 8 is a sectional view taken along the line 8—8 of FIG. 7.
Figure 9:
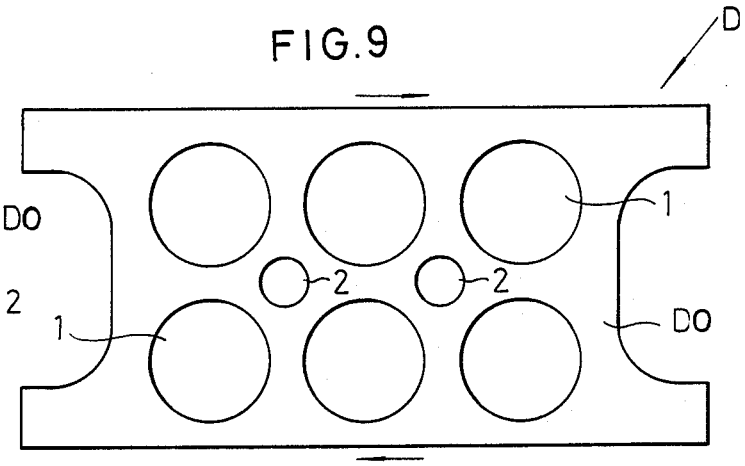

When the multiple tiers of openings 1 are formed, portions of the damper surrounding openings 1 are left unplasticized. Therefore, in order to increase the plasticity of these portions as much as possible, and hence improve the energy absorbability, embodiments as shown in FIGS. 7 through 9 are adapted to plastically deform the portions surrounding the openings 1 by providing small blind holes 2 therein transversely extending substantially halfway into the plate.

Figure 10:
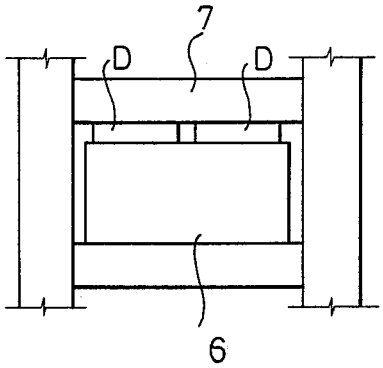
FIG. 10 is an elevational view showing the elasto-plastic damper installed between a wall and a beam.
Figure 11:
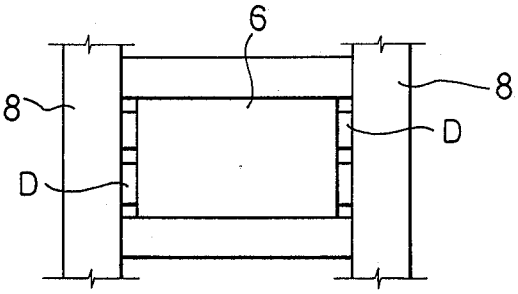
FIG. 11 is an elevational view showing the elasto-plastic damper installed between a wall and a·pillar.

FIG. 10 shows an embodiment in which dampers are connected between a wall 6 and a beam 7. FIG. 11 shows an embodiment in which dampers are connected between the wall 6 and a pillar 8. In both of these embodiments, when the relative displacement of both of the structural members occurs, the elasto-plastic dampers are subjected to shearing deformation to absorb the vibrational energy in the displacement direction.

Figure 12:
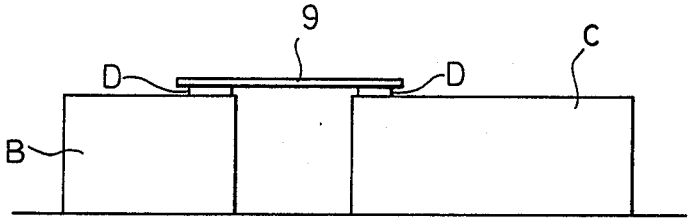
FIG. 12 is an elevational view showing the elasto-plastic damper installed between adjacent unlike structures.

FIG. 12 shows an embodiment in which, when adjacent structures B, C, differing from each other in natural period, are connected to each other through an expansion joint 9, the elasto-plastic damper D is connected between each structure B and the connecting member 9.

Figure 14:
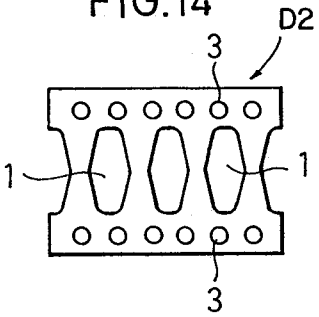
FIG. 14 is a front elevational view showing another example of a plate-like elasto-plastic damper similar to FIG. 13.
Figure 13:
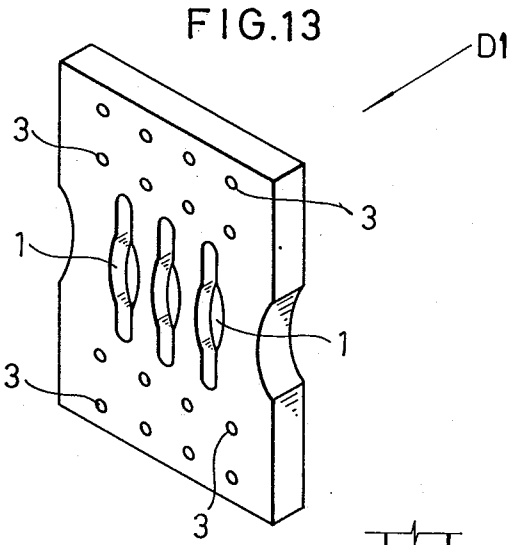
FIG. 13 is a perspective view showing a plate-like elasto-plastic damper having bolt holes bored adjacent the upper and lower edges of the damper body.

FIGS. 13 and 14 show elasto-plastic dampers $D_1$ and $D_2$ in which bolt holes 3 for connecting the dampers to the structural members are bored adjacent opposite edges of the plate-like damper bodies.

Figure 15:
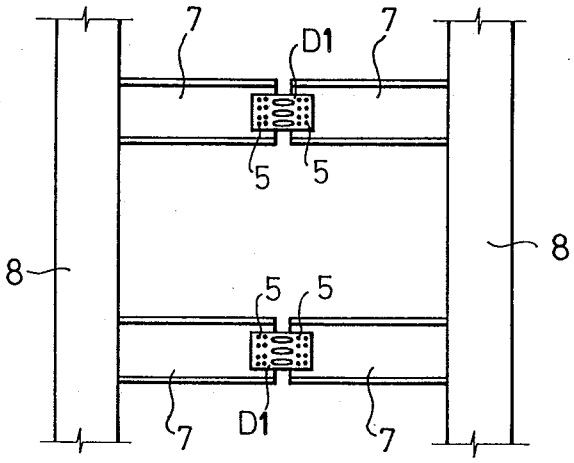
FIG. 15 is an elevational view showing a frame in which a pair of elasto-plastic dampers of FIG. 13 connect pairs of axially aligned bifurcated beams.

In FIG. 15, bifurcated beams 7 are cantilevered in axial alignment and dampers $D_1$ are connected to the free ends of the cantilevered beams 7 by means of bolts 5.

Figure 16:
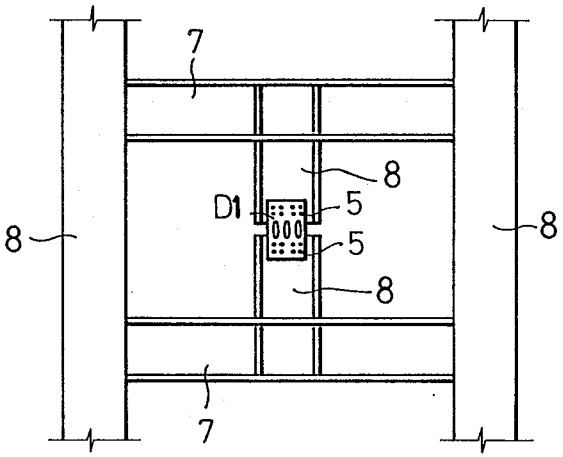
FIG. 16 is an elevational view showing a frame in which an elasto-plastic damper of FIG. 13 connects an axially aligned bifurcated pillar.

In FIG. 16, the pillar 8 connecting to the intermediate portions of the beams 7 is bifurcated midway between beams 7 and the damper $D_1$ connects the bifurcated pillar 8 by means of bolts 5.

Figure 17:
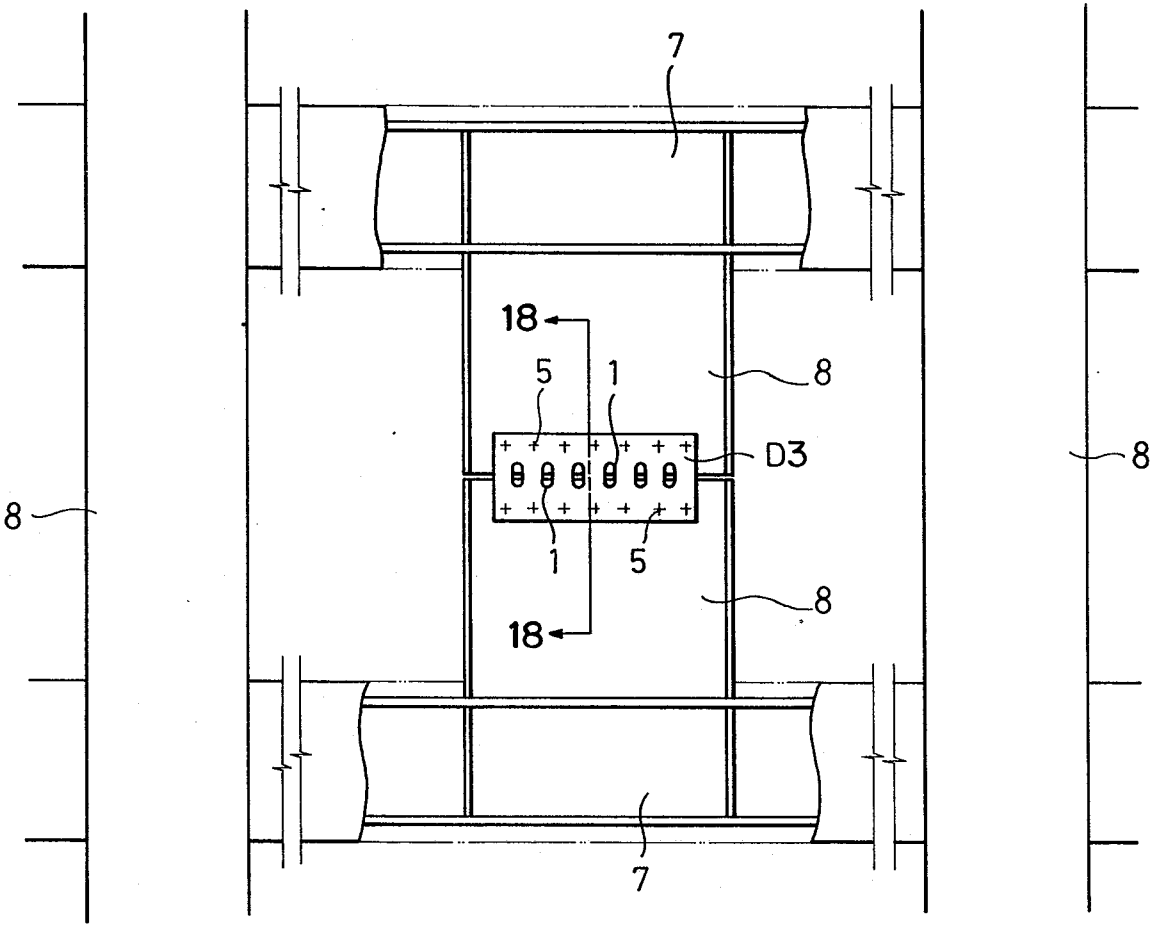
FIG. 17 is an elevational view showing a modification of the frame and damper plate of FIG. 16.
Figure 18:
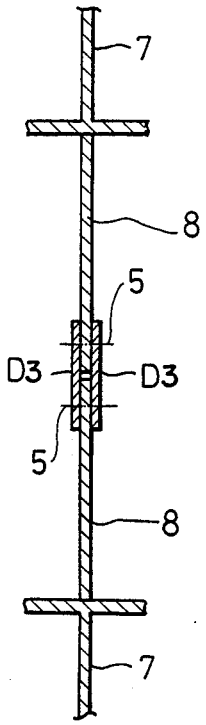
FIG. 18 is a cross-sectional view taken substantially along the line 18—18 of FIG. 17.

FIGS. 17 and 18 show an elongated damper $D_3$ which is suitable for use with exceptionally wide pillars 8. In this case, an elongated elasto-plastic damper $D_3$ is used corresponding to the width of the pillar 8 in order to avoid stress concentration.

Figure 19:
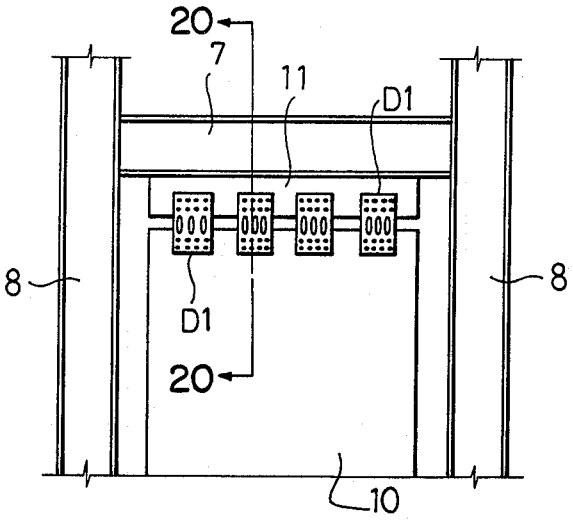
FIG. 19 is an elevational view showing a frame in which the elasto-plastic dampers of FIG. 13 are installed between a wall and a beam.

FIG. 19 illustrates an application of damper $D_1$ in which the elasto-plastic damper is installed between a wall 10 and a beam 7. A bracket 11 is provided on the lower surface of beam 7 for attaching dampers $D_1$.

The elasto-plastic damper in the application shown in FIG. 15 is effective in attenuating the relative displacement between bifurcated beams 7 in the vertical direction, while the dampers in the applications shown in FIGS. 16, 17 and 19 are effective in attenuating the relative displacement between the bifurcated structural members in the horizontal direction.

Figure 20:
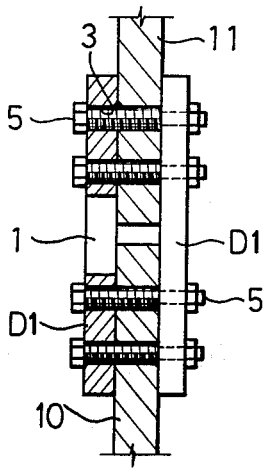
FIG. 20 is an enlarged fragmentary cross-sectional view taken substantially along the line 20—20 of FIG. 19.

Plate-like elasto-plastic dampers $D_1$ may be disposed on the opposite surfaces of the structual members 10 and 11, as shown in FIG. 20.

Figure 21:
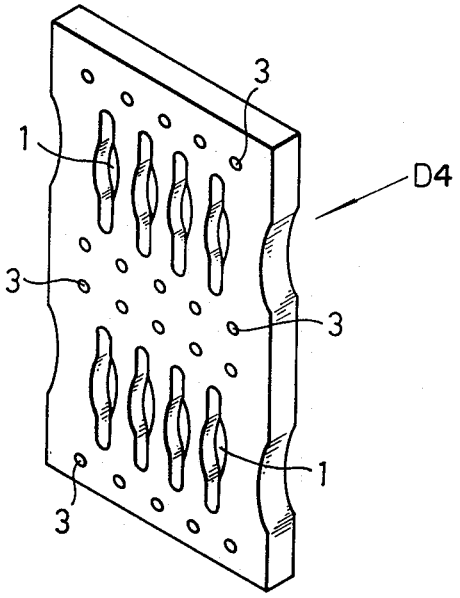
FIG. 21 is a perspective view showing a plate-like elasto-plastic damper having bolt holes provided between openings formed in two tiers.
Figure 22:
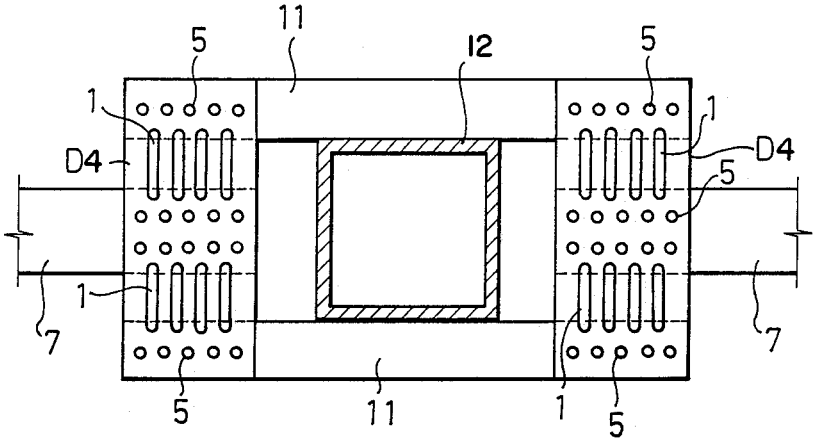
FIG. 22 is a plan view showing elasto-plastic dampers of FIG. 21 used to connect beams to straddle a pillar.

FIG. 21 shows a modification of the damper of FIG. 13. This modified damper $D_4$ has two tiers of openings 1 and four tiers of bolt holes 3. FIG. 22 shows an application of this modified damper in use. The example of the modified damper $D_4$ in use shown in FIG. 22 is an application wherein the elasto-plastic damper $D_4$ is used to connect a bifurcated beam 7 between which a pillar 8 is interposed. In this case, brackets 11 are fastened to the sides of the square pillar 12 by means of welding or the like, and the elasto-plastic dampers $D_4$ are connected to the ends of beams 7 and brackets 11 to thereby provide the attenuation effect on the relative displacement between the pillar 8 and the beams 7 in the horizontal direction.

Figure 23:
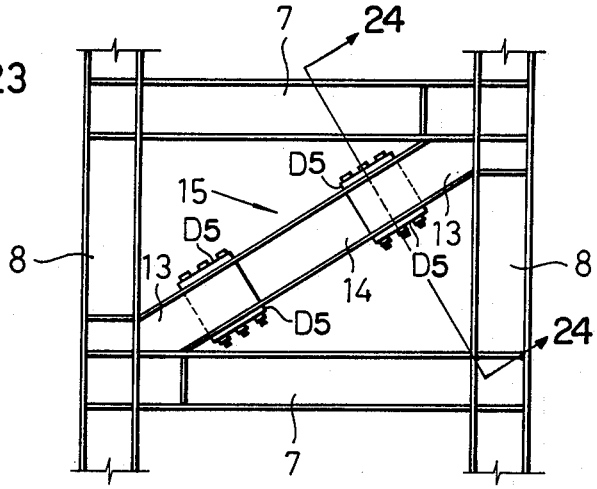
FIG. 23 is an elevational view showing a plate-like elasto-plastic damper used to connect brace members.
Figure 24:
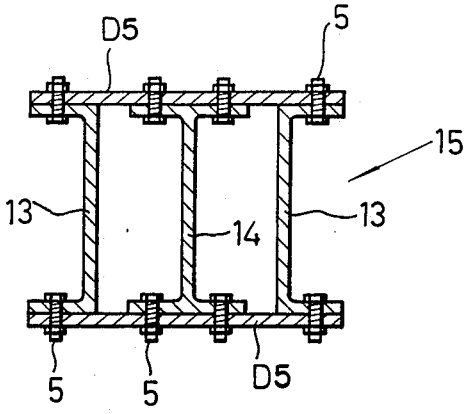
FIG. 24 is a cross-sectional view taken along the line 24—24 of FIG. 23.

An example of the modified damper $D_5$ in use is shown in FIGS. 23 and 24. A brace 15 is fabricated from channel beams 13 and an I-beam 14 which are connected to diagonally opposite corners of a frame consisting of the pillars 8 and beams 7. I-beam 14 is positioned between channel beams 13, which are secured to the diagonally opposite corners of the frame. The elasto-plastic dampers $D_5$ are connected to the overlapping portions of the I-beam 14 and the channel beams 13 to absorb the vibrations at the time of occurrence of the relative displacement between the beams 13 and 14 in the axial direction of the brace 15.

Figure 25:
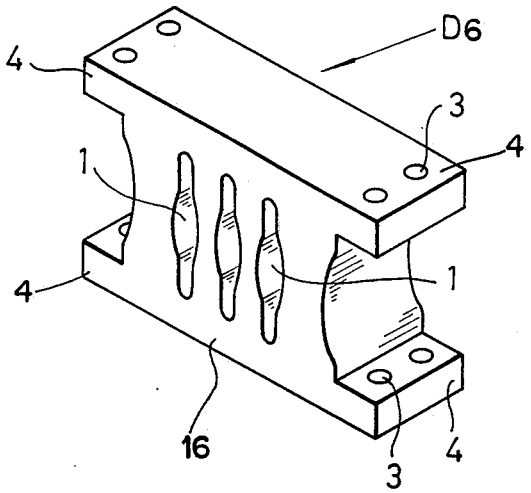
FIG. 25 is a perspective view showing a block-like elasto-plastic damper having flanges projecting from its opposite sides and bolt holes in the flanges.

An elasto-plastic damper $D_6$ as shown in FIG. 25 includes a block-like damper body 16, flanges 4 projecting horizontally from the opposite sides of the damper body and vertically aligned bolt holes 3 provided in the flanges 4.

Figure 27:
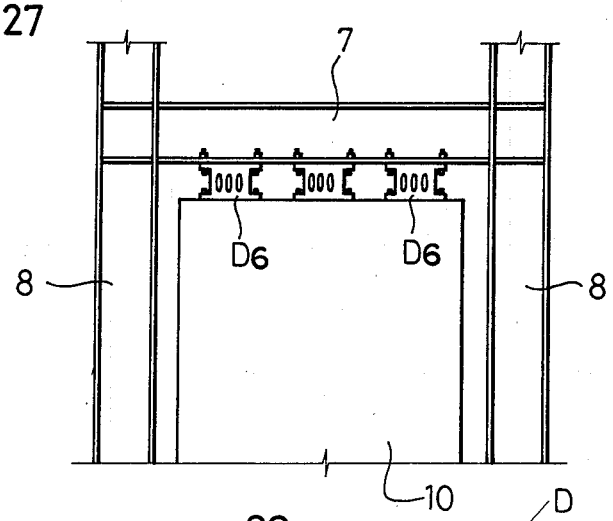
FIG. 27 is an elevational view showing a frame in which block-like elasto-plastic dampers of FIG. 25 are installed between a wall and a beam.

FIG. 27 shows an application of the elasto-plastic damper $D_6$. In this application, the elasto-plastic damper $D_6$ is sandwiched between the upper edge of wall 10 and the lower flange of the beam 7 and is connected thereto by means of bolts 5.

Figure 26:
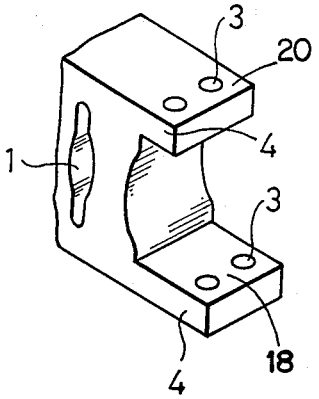
FIG. 26 is a fragmentary perspective view showing a modification of the elasto-plastic damper of FIG. 25, in which the flanges are staggered in length.

In order to provide for bolt clearance when necessary, one damper flange 18 is formed longer than the other flange 20, as shown in FIG. 26.

Figure 28:
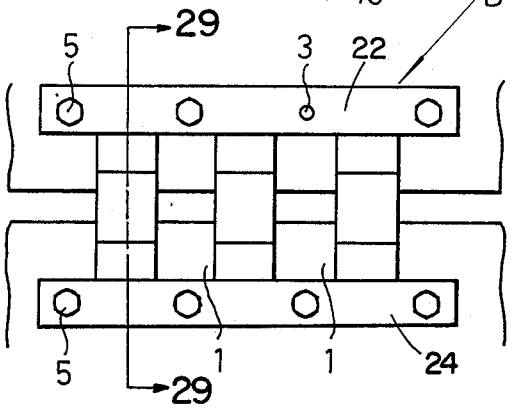
FIG. 28 is a front elevational view showing a plate-like elasto-plastic damper with a tapered medial section connecting a pair of structural members.
Figure 29:
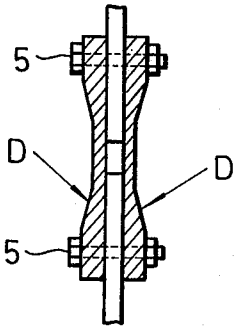
FIG. 29 is an elevational cross-sectional view taken along the line 29—29 of FIG. 28.

FIGS. 28 and 29 show a modified elasto-plastic damper $D_7$ in which the plate thickness adjacent the opening 1 of the damper body is tapered inward from upper and lower body surfaces 22 and 24, respectively, as shown in FIG. 29. So configured, the damper body will plastically yield over its entire span when subjected to shearing deformation. As a result, the damper $D_7$ has a large energy absorbability potential.

Figure 30:
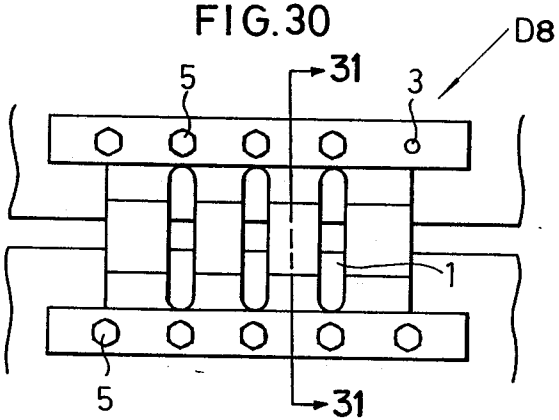
FIG. 30 is a front elevational view showing a modification of the elasto-plastic damper of FIG. 28.
Figure 31:
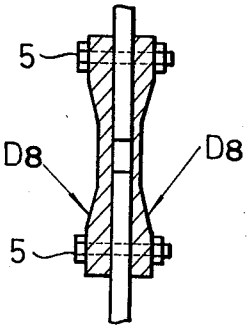
FIG. 31 is an elevational cross-sectional view taken along the line 31—31 of FIG. 30.

FIGS. 30 and 31 show damper $D_8$, which is a modification of the elasto-plastic dampers $D_7$ of FIGS. 28 and 29.

Figure 33:
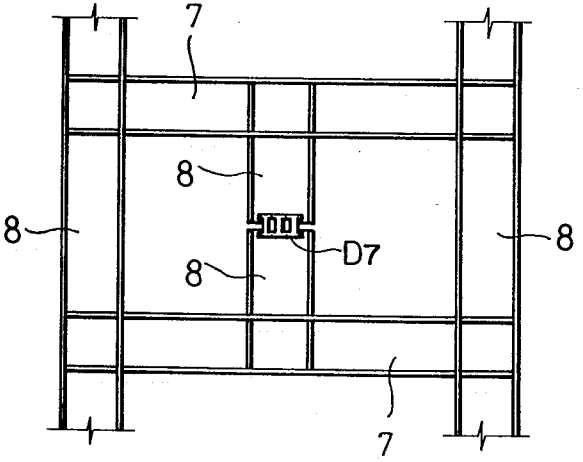
FIG. 33 is an elevational view showing a frame in which an elasto-plastic damper of FIG. 28 connects a bifurcated pillar.
Figure 32:
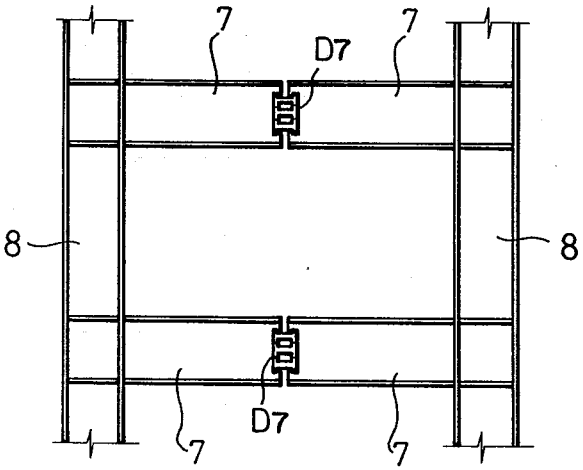
FIG. 32 is an elevational view showing a frame in which a pair of elasto-plastic dampers of FIG. 28 connect a pair of axially aligned bifurcated beams.

FIGS. 32 and 33 show applications of dampers $D_7$ with bifurcated, axially aligned, beams 7 and pillars 8, respectively.

Figure 34:
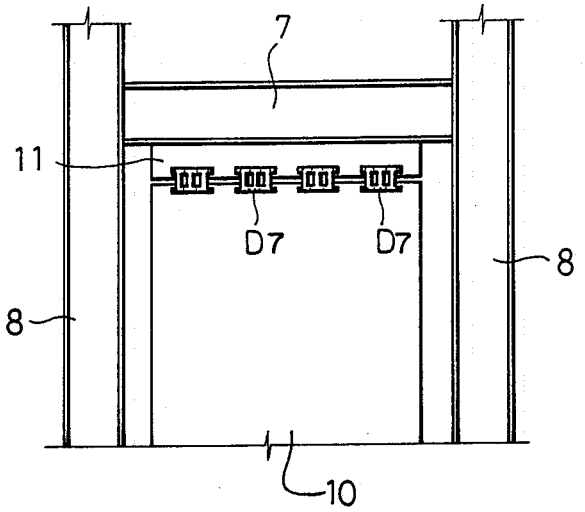
FIG. 34 is an elevational view showing a frame in which a plurality of elasto-plastic dampers of FIG. 28 connect a wall and a beam.

FIG. 34 shows an application of dampers $D_7$ with wall 10, connecting plate 11 and beam 7 of a building structure.

Figure 35:
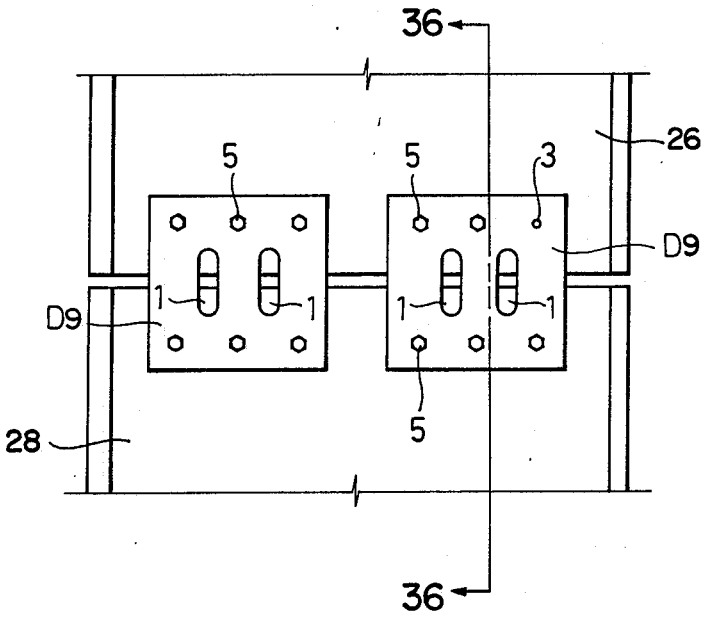
FIGS. 35 and 36 are front and sectional elevational views, respectively, showing another embodiment of the invention in which a plurality of plate-like elasto-plastic dampers, differing from each other in rigidity and/or yield strength, are mounted in stacks on the structural members.
Figure 36:
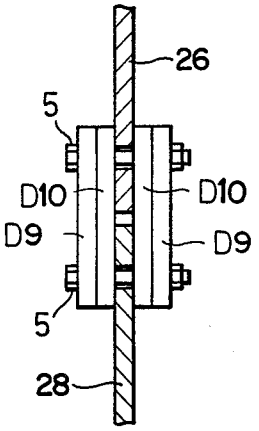

FIGS. 35 and 36 show an embodiment of the invention in which a plurality of plate-like elasto-plastic dampers $D_9$ and $D_{10}$ differing from each other in rigidity and yield strength, are connected in stacks to the structural members 26 and 28 by means of bolts 5.

According to the embodiment of FIGS. 35 and 36, a plurality of elasto-plastic damper plates $D_9$ and $D_{10}$ are individually subjected to elasto-plastic deformation corresponding to the frequency and magnitude of the earthquake vibrations transmitted to the structural members 26 and 28, thereby absorbing vibrational energy. Thus, damper plate plasticization is started successively with the elasto-plastic damper plate having less yield strength. As a consequence, the plurality of elasto-plastic dampers in the mounting structures of FIGS. 35 and 36 function in sequential stages to effectively attenuate earthquake tremors over a wide energy span.

The rigidity and yield strength of each of the plurality of elasto-plastic dampers of FIGS. 35 and 36 may be varied by selection of size, shape, and number of openings 1 and/or variation of the plate thicknesses of the damper bodies.

Although several embodiments of the invention have been described, it will occur to those skilled in the art, upon reading the specification in conjunction with a study of the drawings, that certain modifications may be made to the described dampers. However, it is intended that the invention only be limited by the scope of the appended claims.

What is claimed is:

1. An elasto-plastic damper for connecting spaced apart opposed ends of cantilevered axially aligned structural members of a building to attenuate seismic vibrations of the building comprising: a flat sided substantially rectangular damper member; bolt holes provided in at least one pair of opposed edges of the damper member positioned to align with corresponding bolt holes in the said opposed ends of said cantilevered structural members, said bolt holes being adapted to receive bolts therethrough to secure said damper member to the said opposed ends of said cantilevered structural members; a plurality of open spaces in said damper member aligned to provide predetermined elasto-plastic yield along a predetermined yield line of said damper member when said opposed ends of said cantilevered members are caused to shift due to seismic vibrations.

2. The elasto-plastic damper of claim 1, wherein said open spaces in said damper member are elongated and are axially aligned transversely on opposite sides of said predetermined yield line of said damper member.

3. The elasto-plastic damper of claim 1, wherein said structural members comprise steel girders.

4. The elasto-plastic damper of claim 1, wherein said structural members comprise steel beams.

5. The elasto-plastic damper of claim 1, wherein said structural members comprise steel pillars.

6. The elasto-plastic damper of claim 1, wherein said structural members comprise steel diagonal braces.

7. The elasto-plastic damper of claim 1, wherein said structural members comprise a steel beam and a wall partition.

8. The elasto-plastic damper of claim 1, wherein said structural members comprise at least one steel pillar and a wall partition.

9. The elasto-plastic damper of claim 1, wherein said openings are circular.

10. The elasto-plastic damper of claim 1, wherein said openings are hexagonal.

11. The elasto-plastic damper of claim 1, wherein said openings are polygonal.

12. The elasto-plastic damper of claim 1, wherein said openings are octagonal.

13. The elasto-plastic damper of claim 1, including a plurality of blind holes formed on opposite sides of the damper member, adapted to increase the plasticity of the damper body.

14. The elasto-plastic damper of claim 1, wherein the said open spaces in said damper member are narrow, elongated, and are axially aligned transversely across said predetermined yield line of said damper member.

15. The elasto-plastic damper of claim 14, wherein said open spaces are of keyhole configuration.

16. The elasto-plastic damper of claim 1, wherein a plurality of damper members with matching bolt holes are adapted to be stacked together and secured to structural members by a common use of bolts through said matching bolt holes.

17. The elasto-plastic damper of claim 16 wherein the elasto-plastic properties of each of said plurality of stacked damper members are modified each from the other to provide predetermined and variable elasto-plastic properties of a pre-selected stack of damper members.

18. The elasto-plastic damper of claim 1, wherein a plurality of said damper members are secured to said opposed ends of said cantilevered structural members.

19. The elasto-plastic damper of claim 18, wherein the openings in said damper members are elongated and aligned with the longitudinal axes of said structural members.

20. The elasto-plastic damper of claim 19, wherein said damper members are adapted to have predetermined lines of shear and said openings are positioned transversely of said lines of shear, whereby said members are adapted to yield elasto-plastically along said lines of shear when the said opposed ends of said structural members are subjected to seismic vibrations.

21. The elasto-plastic damper of claim 1, including bolt holes provided intermediate said first-mentioned bolt holes, and openings intermediate said first-mentioned bolt holes and said intermediate bolt holes whereby the ends of a triad of cantilevered structural members may be secured to said damper member to provide elasto-plastic yield, thereby permitting said ends of said cantilevered structural members to shift responsive to seismic vibrations.

22. The elasto-plastic damper of claim 21, wherein a pair of cantilevered beams are horizontally positioned on opposite vertical surfaces of a pillar and the end of a third cantilevered beam is positioned between the ends of said pair of cantilevered beams, said damper member being adapted to be interconnected to said ends of said cantilevered beams to provide said elasto-plastic yield responsive to seismic vibrations of the ends of said cantilevered beams.

23. The elasto-plastic damper of claim 22, wherein a pair of damper members are secured to the opposite ends of said pair of cantilevered beams to secure the ends of a second pair of axially aligned cantilevered beams positioned between and parallel to the opposite ends of said first-mentioned pair of cantilevered beams, whereby said pair of damper members and said pairs of beams straddle said pillar and protect said pillar against destructive seismic vibrations by the interconnection of said pair of damper plates with said pairs of cantilevered beams.

24. The elasto-plastic damper of claim 1, wherein said damper member is block-like, and is provided with bolt hole flanges projecting from each corner of the block-like damper member, and bolt holes in said flanges whereby said damper member may be sandwiched between structural members and bolt-secured thereto.

25. The elasto-plastic damper of claim 24, wherein a pair of opposed flanges are of pre-selected different lengths to avoid interference between bolts in their respective bolt holes during assembly and disassembly of said damper members.

26. The elasto-plastic damper of claim 25, wherein said damper member is sandwiched between a beam and a wall partition.

27. The elasto-plastic damper of claim 24, wherein said damper member is sandwiched between a pillar and a wall partition.

* * * * *